United States Patent [19]

Hopen

[11] 4,214,798

[45] Jul. 29, 1980

[54] METHOD FOR SPOT-KNOCKING THE ELECTRON-GUN MOUNT ASSEMBLY OF A CRT

[75] Inventor: Leonard F. Hopen, Lancaster, Pa.

[73] Assignee: RCA Corporation, New York, N.Y.

[21] Appl. No.: 40,054

[22] Filed: May 17, 1979

[51] Int. Cl.[2] ..... H01J 9/00

[52] U.S. Cl. ..... 316/26; 29/25.11; 316/1

[58] Field of Search ..... 316/1, 26; 20/25.11

[56] References Cited

U.S. PATENT DOCUMENTS

| | | | |
|---|---|---|---|
| 3,323,854 | 6/1967 | Palac | 316/1 |
| 3,736,038 | 5/1973 | Nakanishi et al. | 316/26 |
| 3,966,287 | 6/1976 | Liller | 316/1 |
| 4,052,776 | 10/1977 | Maskell et al. | 316/26 |
| 4,124,263 | 11/1978 | Neuber et al. | 316/26 |
| 4,125,306 | 11/1978 | Coble | 316/1 |

*Primary Examiner*—John McQuade

*Attorney, Agent, or Firm*—E. M. Whitacre; G. H. Bruestle; L. Greenspan

[57] ABSTRACT

A method for spot-knocking a CRT comprising interconnecting the lower-voltage gun elements including the heater, the cathode, the control electrode and the screen electrode, and applying spot-knocking voltages between the anode and the interconnected gun elements with the focus electrode floating electrically; that is, unconnected.

6 Claims, 4 Drawing Figures

METHOD FOR SPOT-KNOCKING THE ELECTRON-GUN MOUNT ASSEMBLY OF A CRT

BACKGROUND OF THE INVENTION

This invention relates to a novel method for spot-knocking the electron-gun mount assembly of a CRT (cathode-ray tube).

In the maufacture of a CRT, it is the practice to electrically process the electron-gun mount assembly therein after the CRT has been completely assembled, exhausted of gases and sealed. One step in this electrical processing is spot-knocking, which involves induced arcing between adjacent electrodes, usually between the focus electrode and an electrode adjacent thereto. Arcing removes projections, burrs and/or particles which would later be sites for the field emission of electrons during the normal operation of the CRT.

In prior spot-knocking methods, the lower-voltage gun elements; that is, the heater, the cathode (K), the control electrode (G1), and the screen electrode (G2), are connected to the focus electrode (G3); and pulsed high voltages, of about twice the normal maximum operating voltage for the CRT, are applied between the anode and the interconnected gun elements.

In recent years, higher operating voltages are being used, with the result that higher spot-knocking voltages must be applied. These higher voltages produce arcs which can cause crazing of the glass neck of the CRT and can cause vaporized metal to deposit on the inside of the neck and on the insulator surfaces of the mount assembly. To reduce these adverse effects, processing times and voltages may be changed with consequent loss of processing capacity and/or increased cost of facilitation. In addition, separate G2–G3 and G3-anode spot-knocking procedures may be necessary.

SUMMARY OF THE INVENTION

The novel spot-knocking method comprises interconnecting the lower-voltage gun elements including the heater, the cathode, the control electrode and the screen electrode, and applying spot-knocking voltages between the anode and the interconnected lower-voltage gun elements with the focus electrode floating electrically. Where there is more than one electrode for focusing, as in a tripotential mount assembly, all of the focusing electrodes are floating electrically. In addition to spot-knocking voltages, voltage pulses of short duration and fast rise time relative to the normal spot-knocking voltages may also be applied between the anode and the lower gun elements of the control electrode.

DETAILED DESCRIPTION OF THE PREFERRED EMBODIMENTS

Figure 1:
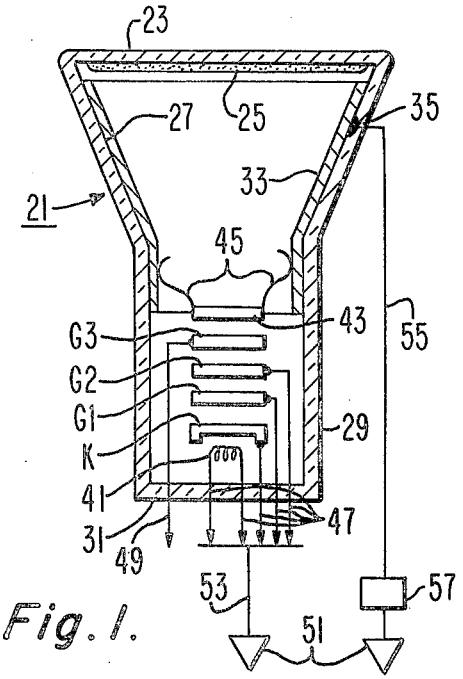
FIGS. 1 to 4 are schematic representations of circuit arrangements for practicing four different embodiments of the novel method.

The novel method may be applied to any electron gun having a cathode and four or more electrodes which are biased independently of one another. There may be a single gun or a plurality of guns in the gun mount of the cathode-ray tube. Where there is more than one gun in the mount, the guns may be in any geometric arrangement. Where there are three guns, as in a color television picture tube for example, the guns may be arranged in a delta array, or in an in-line array, or other array.

The novel method may be applied, for example, to bipotential and tripotential electron gun structures. A bipotential gun structure typically has a heater and cathode K, a control grid G1, a screen grid G2, a single focus electrode G3 and a high voltage electrode, which is often designated as the anode or G4. Although separate elements may be provided for each of the three electron guns of a color picture tube, recent practice has tended to use common elements for G1, G2, G3 and the anode for the three electron guns. A tripotential gun differs from a bipotential in that it employs three focus electrodes for the focusing action instead of only one. A tripotential gun typically has a heater, a cathode K, a control grid G1, a screen grid G2, three focus electrodes G3, G4, and G5, and an anode, which is often designated G6. For the purposes of describing the new spot-knocking procedure, the procedures generally will be explained principally as they relate to a bipotential gun structure. For the tripotential gun structure, the three focus electrodes G3, G4 and G5 are treated in the same manner as the one focus electrode, G3, for the bipotential gun structure.

Many methods of spot-knocking electron-gun assemblies have been used previously in attempts to improve the electrical characteristics of television picture tubes. Most of these methods involve forcing arcs to occur between two adjacent electrodes to remove projections, burrs, and/or particles so that the field emission of electrons between the two elements is significantly reduced at the normal operating potentials. In all cases involving spot-knocking between the anode and the focus electrode G3, positive fluctuating DC high-voltage pulses are applied between these two electrodes with all other electrodes being held at ground potential. An alternative is to ground the anode and apply negative fluctuating DC high-voltage pulses to the remainder of the gun structure. The size, shape and repetition rate of the high-voltage pulses vary widely depending upon the nature of the spot-knocking equipment used. The voltage pules used most frequently for spot-knocking are sinusoidal and are derived from the normal variation of the line voltage. They may be half wave with the lowest portion either at some minimum positive DC level or at ground potential, or they may be full wave, in which case the lowest value is usually clamped at ground potential. Very fast rise time pulses of short duration, sometimes derived from the discharge of a capacitor through a ball gap, have also been used in which current pulses often exceed 100 amperes. Although the power associated with these pulses is very high, the duration of each pulse (often less than one microsecond) limits the energy of the induced arc to levels which are safe for the tube elements. Regardless of the type of pulses usd for the spot-knocking, most users have found it prudent to avoid the application of negative pulses to the anode.

In recent years, improvements in the focusing of the electron spot on the screen have been achieved by the use of increasingly higher voltages on the focusing elements of both bipotential and tripotential types. Because of these higher operating potentials, it is often necessary to provide for spot-knocking between the focus electrode G3 and the screen grid G2; for tripotential types, spot-knocking among the various focus grids G3, G4 and G5 is also believed to be desirable. Previously, these high potentials were introduced through the stem leads. Unless special precautions are taken, such as those outlined in copending U.S. application Ser. No. 21,823 filed Mar. 19, 1979 by F. T. D'Augustine and P. R. Liller, the application of effective voltages which are sufficiently high to accomplish electrode conditioning is prohibited by arcing among the stem leads.

In another spot-knocking method, described in U.S. Pat. No. 4,052,776 to R. Maskell et al, very high amplitude RF bursts are added to the fluctuating DC pulses of relatively low amplitude which are used to spot-knock between G2 and G3. In this method, the fluctuating DC spot-knocking voltage pulses are introduced through the stem lead to the G3 and G5 of a tripotential gun, and the RF burst is introduced through the remainder of the stem leads which are electrically connected. Because the stem leads are close to one another, either the peak DC voltages must be maintained at relatively low values which are of limited effectiveness, or special precautions must be taken to prevent electrical breakdown among the external portions of the stem leads.

Regardless of the spot-knocking method employed, all of the above-mentioned prior methods are subject to the following limitations:

1. For the spot-knocking to be effective, the peak fluctuating DC voltage levels should be very high. Values of approximately twice the normal operating potentials are often used. If a relatively large projection is present on the negative electrode (the acting cathode for the spot-knocking), the large expenditure of energy in this concentrated area often leads to fractures of the glass envelope (neck glass crazing) or causes an inordinate amount of metal to deposit on the neck glass or glass bead insulators.

2. To minimize the undesirable effects described above, excessive heating is avoided by periodically interrupting the application of the pulses and adhering to a minimum duty cycle. This practice prolongs the total time of processing and increases the unit production cost.

3. For some of the tube types, especially those with focus electrodes operating at relatively high potentials, separate spot-knocking facilities must be provided for spot-knocking between the focus element(s) and the screen grid G2. These separate processes not only demand more spot-knocking facilities at additional cost, but they also require access to all of the electrodes involved, which, in turn, requires separate socket leads for each electrode. The latter requirement is expensive (both initially and for maintenance) and may or may not be compatible with other processing requirements for the tube. Alternate sockets may also be required which generally need additional operators to make the socket change at the propitious time(s) during the processing.

The novel method of spot-knocking overcomes the deficiencies delineated above and eliminates the need for providing separate voltage sources, or stations, for spot-knocking between adjacent electrode pairs. The new method provides for supplying the higher voltages normally used for anode-to-focus electrode spot-knocking, but eliminates the need for separate lower voltage supplies as well as the need for providing socket lead(s) to the focus electrode(s). To employ the new method, the focus electrode(s) is disconnected from all power sources (or ground) and allowed to float during the spot-knocking procedure. This method can be used with any of the conventional spot-knocking procedures that are referred to above as prior art.

The application of high voltage fluctuating DC pulses to the anode with the focus electrode(s) floating, along with the simultaneous application of RF bursts to the lower-voltage gun elements if desired, results in the initiation of a series of arcs which are propagated along the entire length of the gun structure. The anode arcs to the floating focus electrode(s), which becomes charged to a high voltage level and, in turn, arcs to the G2 screen electrode. This multiple arcing causes ionization along the entire length of the gun structure and results in an effective scrubbing of the neck glass by electrons, an action which tends to remove contaminant layers and reduce the probability of subsequent arcing. The novel method also eliminates the concentration of the arc energy at the interface between the anode and focus electrode and significantly reduces the probability of glass damage. By a judicious selection of the voltages, the actual values depending on the particular method used and the expended energies associated with the method, the anode voltage pulses can be applied continuously. This continuous action reduces the total time required for spot-knocking and reduces the number of processing units required, leading to significant cost reductions.

Cathode-ray tubes may be processed according to the novel method in a succession of stations having equipments which can apply, for the various processing steps, programs of voltages to the cathode and the various electrodes of each electron gun in the CRT. The CRT may be transported by hand or on a conveyor from station to station as is known in the art. Suitable conveyors are described in U.S. Pat. Nos. 2,917,357 to T. E. Nash and 3,698,786 to Edward T. Gronka. The novel method will be exemplified now on the above-described tube transported by hand. At each station, the tube is placed in a holder therefor, and a socket is connected to the base pins of the CRT.

The general sequence of steps for processing a completely-assembled CRT includes spot-knocking, then hot-shot, then low-voltage aging, then optionally high-voltage aging. An integral implosion protection structure may then be assembled to the CRT. Then, optionally, there may be another step of spot-knocking. Since all of the foregoing steps, except for the novel spot-knocking step, are well described in the prior art, no further description will be made herein. However, embodiments of the novel spot-knocking method will now be described in detail.

FIG. 1 includes a schematic, sectional, elevational view of a CRT 21 including a faceplate panel 23 carrying on its inner surface a luminescent viewing screen 25. The panel 23 is sealed to the larger end of a funnel 27 having a neck 29 integral with the smaller end of the funnel 27. The neck 29 is closed by a stem 31. The inner surface of the funnel 27 carries a conductive coating 33 which contacts an anode button 35.

The neck 29 houses a bipotential electron-gun mount assembly such as the mount assembly described in U.S. Pat. No. 3,772,554 to R. H. Hughes. This assembly includes three bipotential guns only one of which is illustrated in FIG. 1. The mount assembly includes two glass support rods from which the various gun elements are mounted. The gun elements of each gun include a heater 41, a cathode K, a control electrode G1, a screen electrode G2, a focusing electrode G3 and an anode or high-voltage electrode 43. The anode 43 is connected to the conductive coating 33 with snubbers 45. The heater 41, the cathode K, the control electrode G1, and the screen electrode G3, which are referred to herein as the lower-voltage gun elements, are connected to separate stem leads 47 which extend through the stem 31. The focus electrode is also connected to a separate G3 lead 49 which extends through the stem.

During spot-knocking, the stem 31 and stem leads 47 and 49 are inserted into a socket (not shown), and the leads 47 of the lower gun elements are connected together and to ground 51 through a socket lead 53. The G3 lead 49 remains unconnected or floating electrically. The anode button 35 is connected through an anode lead 55 to a source 57 of low frequency pulsed spot-knocking voltage and then to ground 51. The pulses rise from ground initially to peaks of about minus 35±5 kilovolts increasing to peaks of about minus 60±5 kilovolts in 90 to 120 seconds. The pulses are comprised of half-wave rectified AC voltage having a frequency of about 60 hertz. The positive portion of the AC voltage is clamped to ground. The total duration of the pulses may be in the range of 0.1 to 0.2 second (6 to 12 cycles), and the time spacing may be in the range of 0.5 to 1.0 second. By leaving the G3 electrode floating, spot-knocking is more effective and higher voltages can be used, while avoiding the disadvantages usually encountered.

Figure 2:
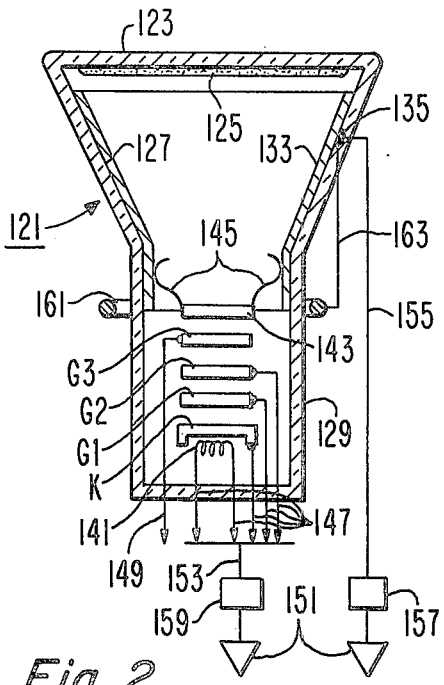

FIG. 2 is similar in structure to that shown in FIG. 1 except in the following three respects. First, a source 159 of high frequency voltage pulses of short duration and fast rise time is inserted in the socket lead 153 between the socket and ground 151. The pulses comprise about 5 cycles of a damped AC of about 300 kilohertz. Second, a metal ring 161 encircles the neck 129 at about opposite the anode 143. The ring 161 is connected to the anode lead 155 with a ring lead 163. Third, the socket (not shown) comprises an insulating silo which houses and electrically isolates the portion of the G3 lead 149 that is outside the CRT. This type of socket is described in U.S. Pat. Nos. 4,076,366 to M. H. Wardell et al and 4,127,313 to B. G. Marks, for example. The high-frequency voltage from the source 159 forces arcing more reliably and imparts a higher voltage whereby gas molecules in the vicinity of the electrodes are more effectively ionized, and the gas ions and arcs more effectively remove undesirable debris. The ring 161 prevents neck puncture and other adverse effects near the end of the spot-knocking procedure.

Figure 3:
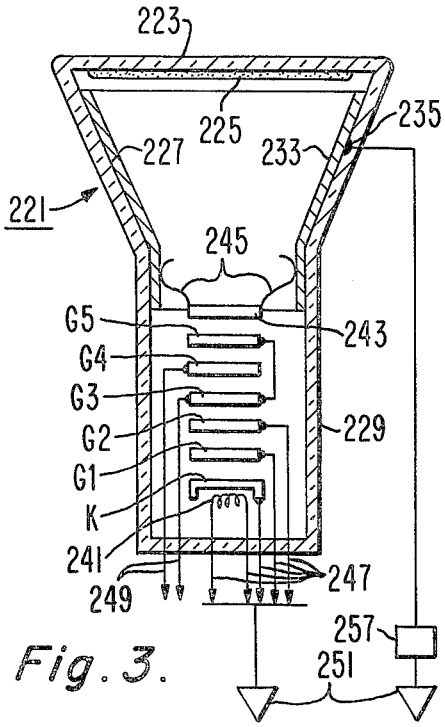
Figure 4:
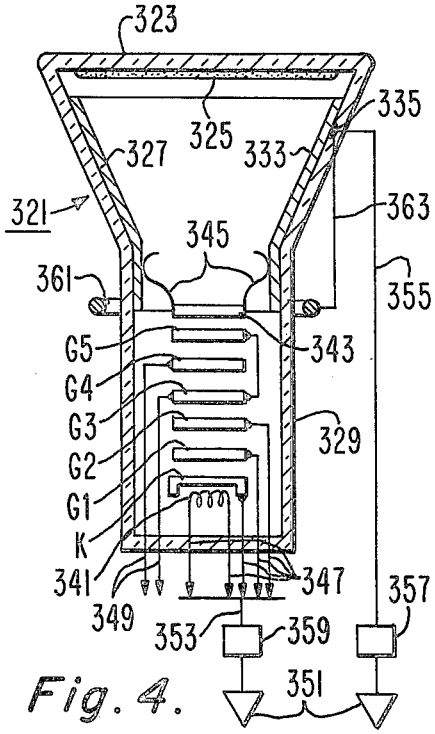

FIGS. 3 and 4 have similar structures to those shown in FIGS. 1 and 2, respectively, except that a tripotential mount assembly is substituted for a bipotential mount assembly. The tripotential mount assembly is similar to a bipotential mount assembly for the purposes of this novel method except that the single focusing electrode G3 is replaced with three focusing electrodes G3, G4 and G5 as is known in the art, with G3 and G5 connected together and two separate stem leads 249 (or 349) connected to G3 and G4 respectively. Both of the stem leads 249 (or 349) are unconnected. Spot-knocking by the novel method is carried out in the same manner as is described for FIGS. 1 and 2 except that the three focus electrodes G3, G4 and G5 are floating electrically.

I claim:

1. A method for spot-knocking an electron-gun mount assembly in an evacuated cathode-ray tube, said mount assembly including a heater, a cathode, a control electrode, a screen electrode, a focus electrode and an anode, said method comprising interconnecting said heater, said cathode, said control electrode and said screen electrode, applying spot-knocking voltages between said anode and said interconnected gun elements, with said focus electrode electrically floating.

2. The method defined in claim 1 wherein said mount assembly is of the bipotential type including a single focus electrode between said screen electrode and said anode.

3. The method defined in claim 1 wherein said mount assembly is of the tripotential type including at least two focus electrodes, and all of the focus electrodes are electrically floating.

4. The method defined in claim 1 wherein said spot-knocking voltages are low frequency fluctuating DC voltage pulses.

5. The method defined in claim 4 including, while applying said spot-knocking voltages, also applying between said anode and said interconnected electrodes, high frequency voltage pulses of short duration and fast rise time.

6. The method defined in claim 1 wherein said spot-knocking voltages are applied to said anode, and said interconnected electrodes are connected to ground.

* * * * *